United States Patent [19]

Dittmann

[11] Patent Number: 4,837,538

[45] Date of Patent: Jun. 6, 1989

[54] ELECTROMAGNETIC RELAY

[75] Inventor: Michael Dittmann, Berlin, Fed. Rep. of Germany

[73] Assignee: Siemens Aktiengesellschaft, Berlin and Munich, Fed. Rep. of Germany

[21] Appl. No.: 244,609

[22] Filed: Sep. 9, 1988

Related U.S. Application Data

[63] Continuation of Ser. No. 167,083, Mar. 11, 1988, abandoned.

[30] Foreign Application Priority Data

Mar. 13, 1987 [DE] Fed. Rep. of Germany ..... 3708286

[51] Int. Cl.[4] ..... H01H 9/02; H01H 13/04

[52] U.S. Cl. ..... 335/202; 335/128

[58] Field of Search ..... 200/293; 335/202, 78–85, 335/128

[56] References Cited

U.S. PATENT DOCUMENTS

| | | | |
|---|---|---|---|
| 3,277,409 | 10/1966 | Faffart | 335/181 |
| 4,533,889 | 8/1985 | Knight . | |
| 4,745,382 | 5/1988 | Dittmann | 335/128 |

FOREIGN PATENT DOCUMENTS

| | | |
|---|---|---|
| 7033403 | 12/1970 | Fed. Rep. of Germany . |
| 3428595 | 2/1986 | Fed. Rep. of Germany . |
| 2473780 | 1/1980 | France . |
| 2027996 | 2/1980 | United Kingdom . |

*Primary Examiner*—E. A. Goldberg
*Assistant Examiner*—Lincoln Donovan
*Attorney, Agent, or Firm*—Hill, Van Santen, Steadman & Simpson

[57] ABSTRACT

An electromagnetic relay includes a coil member having flanges and an angular yoke and a flat armature seated in front of a free end of the yoke. A terminal angle is secured to a leg of the yoke and serves for bearing the armature and for connection of a contact spring connected to the armature. During assembly, the armature assembly composed of the armature, the terminal angle and the leaf spring is preassembled and joined to the coil assembly. Afterwards, the entire magnetic system assembly is placed into a pedestal assembly which includes terminal elements and plug shafts for the coil terminals as well as cooperating contact elements. The plug shafts in the pedestal can be optionally equipped with different cooperating contact elements.

10 Claims, 4 Drawing Sheets

27b
27a
29
27
31
29
29
28
29
24a
30
31
30c
30b
30a
28b
31
28
31
24b
24
20b
20
20a
31
37
22
23
25
18
34
33
17
19
21b
21a
31
21

ELECTROMAGNETIC RELAY

This is a continuation of application Ser. No. 167,083, filed Mar. 11, 1988, now abandoned.

BACKGROUND OF THE INVENTION

1. Field of the Invention

The present invention is related generally to an electromagnetic relay having a coil winding on an axis parallel to a terminal plane, wherein the coil member is mounted on a separately manufactured pedestal in which terminal elements and contact elements are fixed.

In particular, the relay comprises a coil member carrying a winding and having an axis proceeding parallel to the terminal plane of the relay. Support wires for the winding are secured to coil flanges for the coil member, and a core is plugged into the coil member in an axial direction. An angular yoke includes a first leg coupled to an end of the core and a second leg extending parallel to the coil axis adjacent the winding. A flat armature is seated at the free end of the second yoke leg so that the armature forms a working air gap with the free end of the core. A leaf spring is secured to the armature and includes a restoring leg to effect seating of the armature relative to the yoke. The leaf spring includes at least one contact spring leg interacting with at least one cooperating contact element. A terminal element is connected to the leaf spring in electrically conductive fashion. The coil member is arranged on a separately manufactured pedestal in which terminal elements for the coil winding as well as for the contact elements are fixed. The winding support wires are connected at the underside of the coil member to the appertaining terminal elements in the pedestal.

2. Description of the Related Art

A relay is disclosed in German published application No. 34 28 595. The terminal elements of the disclosed relay are formed as flat plugs that are essentially anchored in a pedestal and are subsequently connected to appertaining electrical elements in the coil member. The manufacture of the disclosed coil, however, can only be partially automated since, for example, the leaf spring connected to the armature must be connected to its appertaining terminal element in the pedestal by a stranded conductor. Further, it is also necessary in the relay of the German application as well as in other known relays to direct or change the design of the coil member according to the type of contact elements used. However, different demands are made of contact arrangements for switch relays of this type which are used, for instance, in motor vehicle technology. Thus, for example, either only make-contacts, only break-contacts, switch-over contacts, double-make contacts, or make-contacts having double terminal leads are required in switch relays. Depending on the type of contacts required, however, not only are the contact elements themselves redesigned, but also an appropriate specifically shaped design for the pedestal and coil member must be provided for each type of contact arrangement.

SUMMARY OF THE INVENTION

An object of the present invention is to provide a structural design in a relay of the species initially cited so that it can be manufactured with simpler parts and simpler work steps wherein the work steps are largely automatically executed and different contact equipment can be used in an otherwise unmodified structural format of the pedestal and coil member.

This and other objects of the invention are inventively achieved in a relay having a separately fabricated terminal angle for a leaf spring, wherein the terminal angle is secured to the second yoke leg. This terminal angle has a first section lying flat on the yoke leg and a second section bent-off at an essentially right angle surrounding the end of the armature seated at the yoke leg. A third section of the terminal angle extends toward the underside of the relay and is guided through a plug shaft in a pedestal to form the terminal element for the leaf spring. The pedestal for the relay includes a plurality of optionally equippable plug shafts for different types of cooperating contact elements.

For relays of the present invention, thus, the manufacture thereof is simplified for the greatest variety of types of contact sets and automated assembly is also possible. First, only one type of pedestal and coil member is needed for all types of contact sets. A general division of the overall relay into a pedestal assembly, a coil assembly and an armature assembly simultaneously enables automated fabrication since each of these three assemblies have already been automatically prefabricated and can then be automatically joined to the remaining assemblies. What is important is that, in particular, the armature with its leaf spring and the inherent armature terminal angle can be welded together during prefabrication. This armature terminal angle is welded onto the yoke in an automated fashion. Thus, the armature assembly together with the coil assembly can be inserted into the pedestal without requiring a subsequent contacting step between the armature and the pedestal.

Expediently, the restoring leg of the leaf spring is formed as a frame shape, wherein a fastening tongue extends from a free end of the frame into region bounded by the frame and is secured to a section of the terminal angle. A greater spring length for the restoring leg is achieved as a result of the frame-shaped leaf spring. This restoring leg, as needed, can also be bent or angled off in accordance with the angle of the terminal angle. As a result, the spring characteristics can be even further softened. Upon actuation of the armature, the angled-off restoring legs of the spring assume the transverse motion while the armature rolls off the yoke without transverse movement.

In order to simplify contacting of the winding supporting wires with the appertaining terminal elements, the coil terminal elements each expediently have an angled-off seating ridge at surfaces in the region of the outsides of the relay. As a result, these connection locations are easily accessible to welding devices. Electrical components that are connected either parallel to or in series with the coil winding can also be welded on at the same time. Such components are preferably accommodated in corresponding chambers in the pedestal.

As already mentioned, the pedestal of the present relay is formed so that various types of contact sets can be accommodated without structurally modifying the pedestal. Expediently, two plug shafts are accommodated in the pedestal so that a make-contact cooperating contact element can be anchored in one and a break-contact cooperating contact element can be anchored in the other. In this case, the break-contact cooperating contact element is angled-off or bent so that it is guided in the channel of the pedestal and ends up in a position residing opposite the make-contact cooperating contact element. In the case, however, where a double make-contact is desired instead of the switch-over contact, a further make-contact cooperating contact element can be plugged into the same plug shaft as the break contact cooperating contact element or, a second terminal element for a single make-contact cooperating contact can also be plugged in. A make-contact cooperating contact element, moreover, is angularly fashioned and has a cross web resting on the coil member so that the coil member and the pedestal are held together by the make contact cooperating contact element. Furthermore, it is expedient that the terminal elements anchored in the pedestal each have at least one shoulder resting on the upper side of the pedestal and are clamped to the underside of the pedestal with an obliquely directed catch tab.

In accordance with the design and arrangement of the cooperating contact elements, the leaf spring may also include different spring legs in different embodiments. Instead of a simple make-contact spring, thus, it is possible to provide a switch-over spring with contact pieces provided at both sides, or to provide a fork shaped split spring. In the latter case, the parallel contact legs can serve either as a double make-contact or as a contact bridge, or also can form a separate break-contact and make-contact spring for a switch-over contact. The use of an additional stranded conductor for carrying high currents to the contact spring is also possible in some embodiments. In this case, the stranded conductor can be automatically applied during prefabrication between the terminal angle and the contact spring leg sub-assembly. No subsequent connection of the stranded conductor to the pedestal is, thus, required in this case.

DESCRIPTION OF THE PREFERRED EMBODIMENTS

Figure 1:
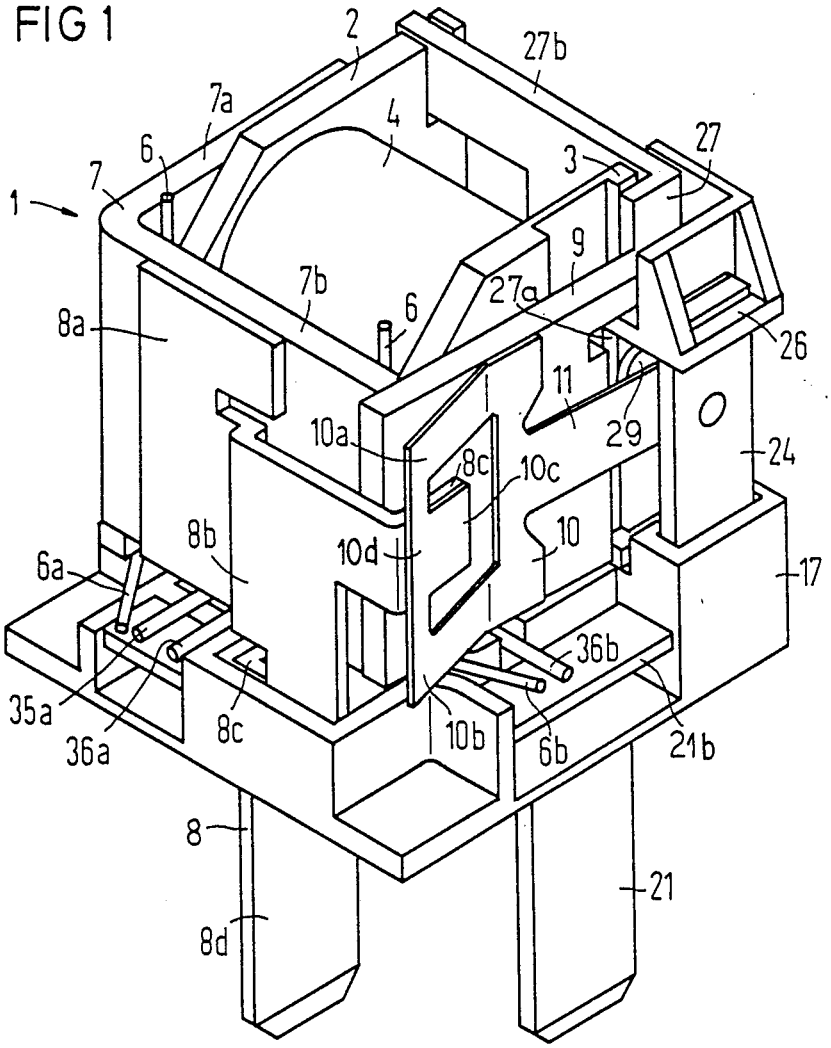
FIG. 1 is a perspective view of a completely assembled relay according to the principles of the present invention.

In FIG. 1, an electromagnetic relay of the invention includes a coil assembly or coil member 1 (which shown separately in FIG. 5) comprising first and second flanges 2 and 3 and a winding 4 applied therebetween. A pair of winding supporting wires 6 are provided, each secured in one of the coil flange 2 and 3. These winding supporting wires 6 are embedded in the coil member 1, such as by being injected or by being plugged in. The coil member 1 includes an axial opening into which is plugged in a core 5 (shown in FIG. 5) that is connected to a yoke 7 in the region of the first coil flange 2. The yoke 7 is angularly shaped, or bent, and has a first yoke leg **7*a* connected to the core 5 and a second yoke leg 7*b* extending next to the coil winding 4** roughly parallel to the axis thereof.

A plate-shaped armature 9 is seated at a free end of the second yoke leg **7*b* with the assistance of a terminal angle 8 and a leaf spring 10. The armature 9 forms a working air gap with a free end of the core 5**.

The armature terminal angle 8 has a first section **8*a* lying flat on the second yoke leg 7*b* and is connected thereto by, for example, spot welding. A middle portion 8*b* of the armature terminal angle 8 is slightly crimped away from the second yoke leg 7*b* in order to assure free mobility of the armature 9. Moreover, a third section 8*c* of the terminal angle 8 forms a fastening section by being bent or angled at generally a right angle around the seated end of the armature 9 so that the armature 9 lies between the fastening leg or section 8*c* and the free end or bearing end of the second yoke leg 7*b***.

The fastening leg or section **8*c* of the terminal angle 8 carries the leaf spring 10. In particular, a frame-shaped restoring leg of the leaf spring 10 formed by portions 10*a* and 10*b* includes a fastening tongue 10*c* projecting into the frame-shaped portion from a free end 10*d* of the leaf spring 10. The free end 10*d* of the frame-shaped part of the leaf spring 10, as well as the fastening tongue portion 10*c* can, in a second exemplary embodiment shown in FIG. 2, be bent around the bearing end of the armature 9 at an angle corresponding to that of the fastening section 8*c* of the terminal angle 8. This extends the length of the spring path and softens or reduces the force of the spring. Such feature, however, is not required in all cases, as may be seen by examination of alternate embodiments shown in FIGS. 6 through 8**.

The terminal angle 8 includes a terminal element **8*d* in the form of a flat plug extending in a downward direction. This flat terminal element 8*d* is conducted through a plug shaft or opening 32 (see FIG. 3) in a pedestal 17 during assembly. By bending somewhat the fastening section 8*c* of the terminal angle 8 on which the fastening tongue 10*c* of the leaf spring 10 is applied, the restoring force of the leaf spring 10** can be adjusted, wherewith the response voltage of the relay can be set.

Figure 2:
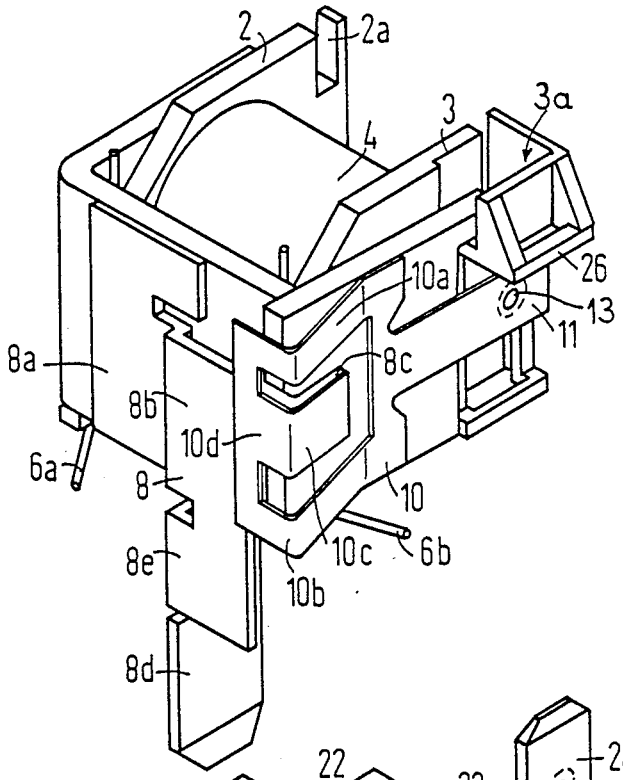
FIG. 2 is a perspective view of a coil assembly with an armature assembly of a second embodiment of a relay according to the invention.
Figure 7:
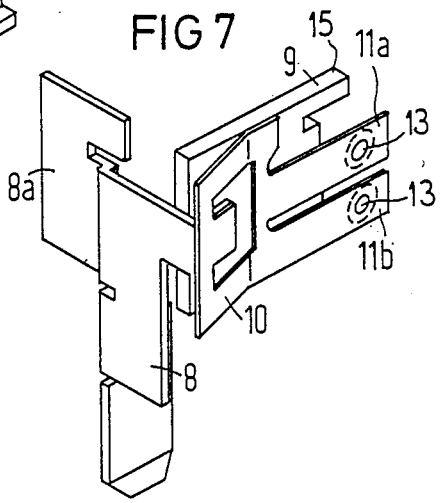
FIG. 7 is a perspective view of an armature assembly having a another embodiment of a contact spring.
Figure 6:
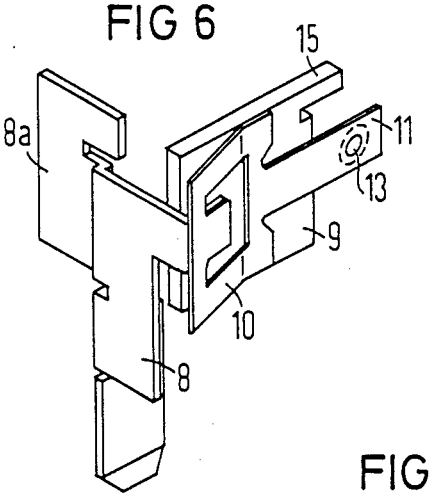
FIG. 6 is a perspective view of an armature assembly showing a one embodiment of a contact spring.
Figure 8:
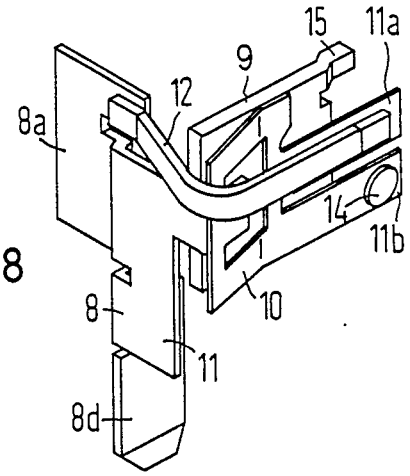
FIG. 8 is a perspective view of an armature assembly having a further embodiment of a contact spring.

The leaf spring 10 includes a section extending beyond the armature 9 to form a contact spring 11. The contact spring 11, as shown in FIGS. 1, 2, and 6, forms a single spring leg or, as shown in FIGS. 7 and 8, is split to form two spring legs **11*a* and 11*b*. Since the leaf spring 10 must also carry the switching or RMS current, it is composed of highly conductive material which is usually a copper alloy. Power is supplied to the leaf spring 10 through the terminal angle 8 and the fastening tongue 10*c*. For special applications when extremely high currents are to be conducted through the spring 10, an additional stranded conductor 12 is connected between the terminal angle 8 and the contact spring 11 or, respectively, the spring leg 11*a*, as shown in FIG. 8. Since the stranded conductor 12 is not fastened to the pedestal 17**, it can be fastened during automated prefabrication of the magnetic system elements.

The contact spring 11 of FIGS. 2 and 6 are simple make-contact or break-contact springs having a simple contact piece 13. When the contact spring 11 is a switch-over spring, then the contact piece 13 is applied to both sides thereof. In the embodiment of FIG. 7, the spring legs **11*a* and 11*b* are provided as a double make-contact and therefor each carry a contact piece 13. In the embodiment of FIG. 8 is shown a switch-over spring arrangement wherein the spring leg 11***a* carries a make-contact piece only on the side facing away and the stranded conductor 12 is welded on the front side of the leg 11*a*. A break contact piece 14 is applied to the second spring leg 11*b* in this embodiment. Other arrangements of contacts are also contemplated.

As can be seen in FIGS. 6, 7 and 8, the armature 9 includes at its free end a stop peg 15 which, for make-contact embodiments, strikes against a corresponding stop face 16 (shown in FIG. 5) of the coil member 1 to define a quiescent position of the armature 9. In break-contact or switch-over contact embodiments, the stop peg 15 is bent as shown in FIG. 8 and, therefore, no longer defines the quiescent condition but serves as impact protection.

Figure 3:
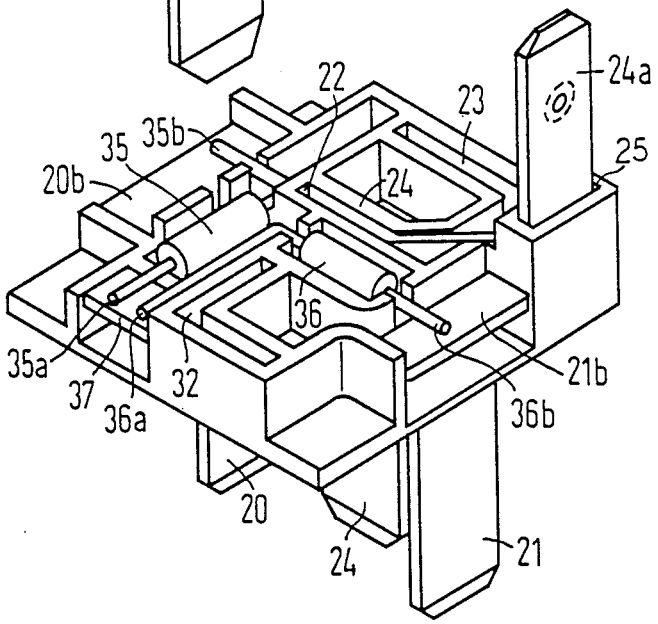
FIG. 3 is a pedestal assembly for the coil assembly of FIG. 2.
Figure 4:
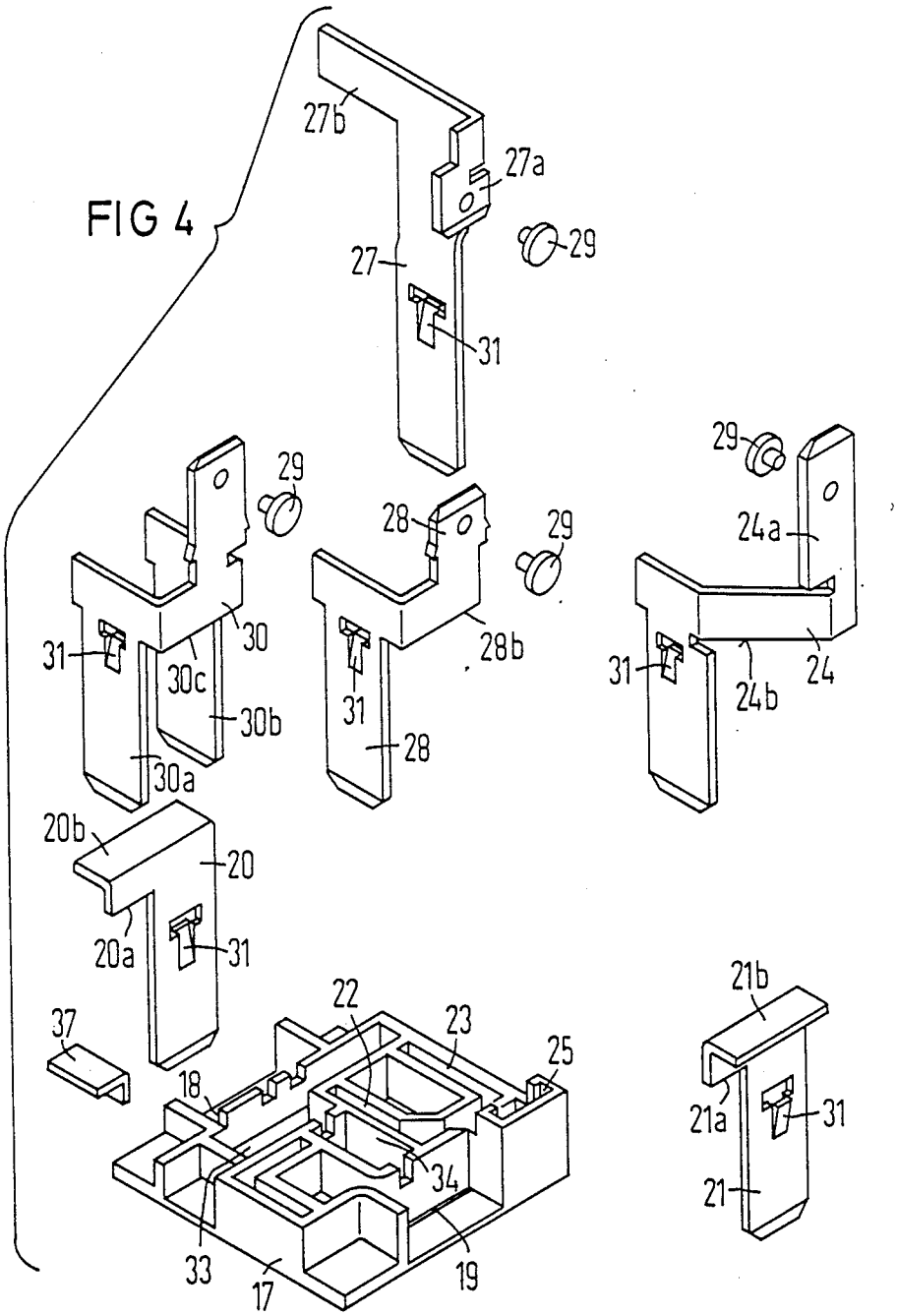
FIG. 4 is an exploded view of a pedestal assembly including an assortment of various optional terminal elements for use therein.

The pedestal 17 which is best shown in FIGS. 3 and 4 includes plug shafts 18 and 19 for coil terminal elements 20 and 21 and also includes further plug shafts 22 and 23 for various cooperating contact elements. According to FIG. 3, a break-contact element 24 is accommodated in the plug shaft 22 with a contact section 24*a* seated in a chamber 25 of the pedestal 17. After assembly, the contact section 21*a* is also supported in a stop frame 26 of the coil member 1. For example, a make-contact element 27 may be secured in the plug shaft 23 which yields a switch-over contact arrangement together with the break-contact 24.

When, however, a double make-contact relay is desired, a further make-contact 28 (FIG. 4) is inserted into the plug shaft 22 instead of the break contact 24. The contact leg 28*a* is then seated in alignment under the contact leg 27*a* so that, for example, a double spring leg 11*a* and 11*b* as shown in FIG. 7 bridges the two contact pieces 29 of the cooperating contact elements 27 and 28.

Under certain conditions, however, a simple make-contact embodiment for switching high currents may also be desired. In this case, a cooperating contact element 30 (FIG. 4) is anchored in the two plug shafts 22 and 23 with respective two terminal elements 30*a* and 30*b*. Thus, depending upon the type of contact arrangement desired, the make-contact element 27 may be used with either the break-contact element 24 or the further make-contact element 28. Since the contact element 30 uses both plug shafts 22 and 23, it is used alone in the illustrated embodiment.

All of the terminal elements have shoulders, for example, 20*a*, 21*a*, 24*b*, 28*b* and 30*c*, which lie on the upper side of the pedestal 17 or on the coil member 1, such as the shoulder 27*b* of the terminal element 27. In order to secure the fastening of the terminal elements in the pedestal 17, all terminal elements have at least one obliquely positioned catch tab 31 which resiliently yields somewhat during assembly as the terminals are plugged through the pedestal 17 and which springs back when through the pedestal 17 and clamps against the underside of the pedestal 17.

The pedestal 17 also includes an angular plug shaft 32 into which is plugged the terminal angle 8. Likewise, the pedestal 17 includes chambers 33 and 34 for accepting additional component parts 35 and 36, such as diodes, as can be seen in FIG. 3. Such component parts 35 and 36 are welded to the coil terminal elements 20 and 21 and, therefore, may be connected either parallel to or in series with the coil winding 4. The coil terminal elements 20 and 21 have flat bentover portion 20*b* and 21*b* at their upper sides which offers a large seating surface for the bent winding supporting wires 6*a* and 6*b* and for the terminal leads 35*b* and 36*a* of the additional components 35 and 36, respectively. This enables welding connections to be automatically carried out in a simple way. The position of the bent-over portions 20*b* and 21*b* at the edges of the pedestal 17 provide easy accessability by welding equipment.

Figure 5:
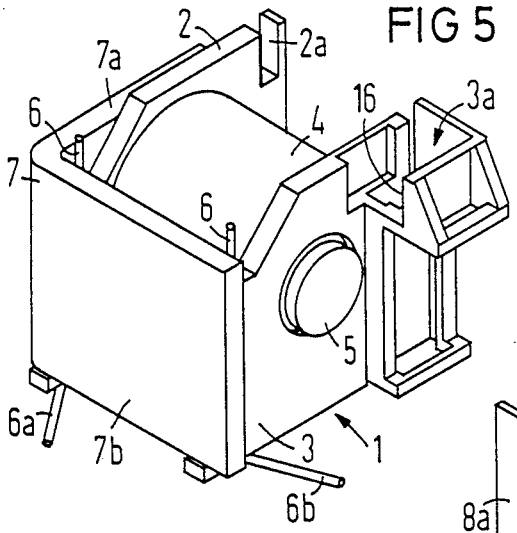
FIG. 5 is a perspective view of a coil assembly for the present relay.

During assembly of the relay, the armature assembly which is preassembled in accordance with FIGS. 6 through 8 is connected to the preassembled coil assembly of FIG. 5 to provide an assembly as shown in FIG. 2. The section 8*a* of the terminal angle 8 is welded to the second yoke leg 7*b* at this point. Afterwards, the subassembly, or magnetic system, shown in FIG. 2 is joined to the pedestal assembly shown in FIG. 3 by plugging the armature terminal angle 8 into the plug shaft 32 with an angular region 8*e* fixed in the angular plug shaft 32. When the break-contact cooperating contact element 24 is provided, the leg 24*a* is plugged into the frame stop 26 of the coil member 1. Thereafter, the bent winding supporting wires 6*a* and 6*b* are connected by welding to the corresponding terminal angles. Thus, the wire 6*b* is welded to the bent-over section 21*b* of the terminal element 21, whereas the terminal wire 6*a* in the illustrated embodiment is not welded directly to the terminal element 20 since a further component or diode 35 is to be connected in series with the winding 4. The terminal wire 35*a* of the diode 35 and the terminal wire 36*a* of the additional component or diode 36 is welded onto an angular connecting element 37 along with the terminal wire 6*a*. The angular connecting element 37 is likewise accommodated in a chamber in the pedestal 17. If the series diode 35 where not present, the terminal wire 36*a* could be bent so that it could be welded directly to the section 20*b* of the terminal element 20. It is, of course, possible to provide additional and/or other components in their own compartments of the pedestal 17.

Subsequently, the make-contact cooperating contact element 27 is plugged through a plug shaft 3*a* (see FIG. 5) of the coil member flange 3 and through the plug shaft 23 of the pedestal 17. A cross-stay 27 engages a recess 2*a* of the coil flange 2 and thus provides additional securing means for holding the coil assembly on the pedestal assembly.

Normally, a cap is inverted over the assembled relay which is capable of being connected to the pedestal 17 in wash-tight or water tight fashion. Such cap is not shown here since it is already very well known in the art. The terminal elements in the present example are shown as flat plug elements. When needed, of course, they can also be pin terminals such as for integration on printed circuit boards. Likewise, the illustrated contact rivets 29 can also be formed as contact elements of some other format.

Although other modifications and changes may be suggested by those skilled in the art, it is the intention of the inventor to embody within the patent warranted hereon all changes and modifications as reasonably and properly come within the scope of his contribution to the art.

I claim:

1. An electromagnetic relay, comprising:

a coil member carrying a winding and having an axis extending parallel to a terminal plane of said relay, said coil member including coil flanges:

winding supporting wires secured in said coil flanges;

a core extending into said coil member in a direction of said axis;

an angular yoke having a first leg coupled to an end of said core, said angular yoke having a second leg extending parallel to said axis and adjacent said winding;

a flat armature seated on a free end of said second leg of said angular yoke, said flat armature forming a working air gap with a free end of said core;

a leaf spring having a restoring leg biasing said flat armature relative to said angular yoke, said leaf spring having at least one contact spring leg;

at least one cooperating contact element cooperating with said at least one contact spring leg;

a separately manufactured pedestal having said coil member arranged thereon, said pedestal having a plurality of optionally equippable plug shafts for different types of cooperating contact elements;

terminal elements for said coil member and for said contact elements being fixed in said pedestal;

said winding supporting wires being at an underside of said coil member and being connected to appertaining ones of said terminal elements and;

a separately fabricated terminal angle connected to said leaf spring in electrically conductive fashion and being secured to said second leg of said angled yoke, said terminal angle having a first section lying flat on said second leg of said angular yoke, said terminal angle having a second section bent at a substantially right angle relative to said first section, said second section surrounding an end of said flat armature that is seated on said angular yoke, said terminal element having a third section extending relative to an underside of said relay and forming a terminal element for said leaf spring.

2. An electromagnetic relay as claimed in claim 1, wherein said restoring leg of said leaf spring is frame-shaped, said restoring leg having a fastening tongue extending into a frame of said frame-shaped restoring leg from a free end of said restoring leg, said fastening tongue being secured to said second section of said terminal angle.

3. An electromagnetic relay as claimed in claim 1, wherein said restoring leg of said leaf spring is bent at an angle following said angle of said terminal angle.

4. An electromagnetic relay as claimed in claim 1, wherein said terminal elements anchored in said pedestal each include an angled seating web at a surface for contacting with said winding supporting wires.

5. An electromagnetic relay as claimed in claim 1, wherein said pedestal is provided with chambers for accepting additional components.

6. An electromagnetic relay as claimed in claim 1, wherein said pedestal includes a first plug shaft for a make-contact cooperating contact element and a further plug shaft for a further cooperating contact element.

7. An electromagnetic relay as claimed in claim 1, wherein said at least one cooperating contact element includes a cooperating contact element having an angled cross-web that holds said coil member and said pedestal together.

8. An electromagnetic relay as claimed in claim 1, wherein said terminal elements each have at least one shoulder resting on an upper side of said terminal and have an obliquely placed catch tab clamped to an underside of said pedestal.

9. An electromagnetic relay as claimed in claim 1, wherein said leaf spring includes two parallel contact legs.

10. An electromagnetic relay as claimed in claim 1, further comprising:

a stop peg extending from a free end of said armature and defining a quiescent position of said armature when said relay is equipped with only a make-contact and serves as impact protection when said relay is equipped with a switch-over contact.

* * * * *